US005921108A

United States Patent [19]

Bonaquist

[11] Patent Number: 5,921,108

[45] Date of Patent: Jul. 13, 1999

[54] REFLUX CONDENSER CRYOGENIC RECTIFICATION SYSTEM FOR PRODUCING LOWER PURITY OXYGEN

[75] Inventor: Dante Patrick Bonaquist, Grand Island, N.Y.

[73] Assignee: Praxair Technology, Inc., Danbury, Conn.

[21] Appl. No.: 08/982,484

[22] Filed: Dec. 2, 1997

[51] Int. Cl.[6] ..... F25J 3/04

[52] U.S. Cl. ..... 62/643; 62/645; 62/903; 62/908

[58] Field of Search ..... 62/643, 908, 903, 62/645

[56] References Cited

U.S. PATENT DOCUMENTS

| | | | |
|---|---|---|---|
| 3,258,930 | 7/1966 | Jakob . | |
| 3,508,412 | 4/1970 | Yearout . | |
| 3,535,886 | 10/1970 | Hoffman . | |
| 3,563,047 | 2/1971 | Hoffman | 62/908 X |
| 3,756,035 | 9/1973 | Yearout . | |
| 4,289,515 | 9/1981 | Yearout | 62/645 |
| 4,308,043 | 12/1981 | Yearout | 62/645 |
| 4,533,375 | 8/1985 | Erickson | 62/651 |
| 5,611,219 | 3/1997 | Bonaquist | 62/646 |
| 5,664,438 | 9/1997 | Bonaquist et al. | 62/645 |
| 5,666,824 | 9/1997 | Bonaquist | 62/646 |
| 5,678,427 | 10/1997 | Bonaquist et al. | 62/650 |

*Primary Examiner*—Christopher B. Kilner
*Attorney, Agent, or Firm*—Stanley Ktorides

[57] ABSTRACT

A method for directly producing lower purity oxygen with high recovery, employing a non-adiabatic distillation device within a distillation column to provide high purity liquid nitrogen reflux to the upper section of the column. This invention provides for a variety of feed air options to the non-adiabatic distillation device and to the distillation column.

8 Claims, 5 Drawing Sheets

REFLUX CONDENSER CRYOGENIC RECTIFICATION SYSTEM FOR PRODUCING LOWER PURITY OXYGEN

TECHNICAL FIELD

This invention relates generally to cryogenic rectification and, more particularly, to cryogenic rectification for the production of lower purity oxygen.

BACKGROUND ART

There are many uses of oxygen wherein commercial grade high purity oxygen is not necessary and lower purity oxygen may be used. However, many lower purity oxygen processes are not economically viable. Oxygen recoveries, unit power requirements, or capital costs often make lower purity oxygen production economically unattractive. Providing an efficient process to directly produce lower purity oxygen is desirable.

Accordingly, it is an object of this invention to provide a system for producing lower purity oxygen which is more efficient and cost-effective than presently available systems.

SUMMARY OF THE INVENTION

This invention comprises a method for producing lower purity oxygen by cryogenic rectification of feed air employing a non-adiabatic distillation device. The method of this invention reduces the thermodynamic irreversibilities within the distillation column enabling more cost-effective operation.

In particular, one aspect of the invention is:

A method for producing lower purity oxygen by cryogenic rectification of feed air employing a non-adiabatic distillation device within a distillation column, comprising the steps of:

(A) condensing at least a portion of feed air to produce nitrogen-enriched vapor;

(B) passing the nitrogen-enriched vapor to a non-adiabatic distillation device situated within a distillation column, said distillation column having at least one upper section and at least one lower section with the non-adiabatic distillation device located therebetween, and partially condensing the nitrogen-enriched vapor therein to produce a higher purity nitrogen-enriched vapor;

(C) condensing the higher purity nitrogen-enriched vapor to produce a higher purity nitrogen-enriched liquid and passing the higher purity nitrogen-enriched liquid into an upper section of the distillation column; and (D) producing lower purity oxygen by cryogenic rectification within the distillation column and recovering lower purity oxygen from a lower section of the column.

Another aspect of the invention is:

A method for producing lower purity oxygen by cryogenic rectification of feed air employing a non-adiabatic distillation device within a distillation column, comprising:

(A) providing a lower pressure feed air stream and a higher pressure feed air stream having a first portion and a second portion, expanding the first portion of the higher pressure feed air stream and combining the expanded first portion of the higher pressure feed air stream with the lower pressure feed air stream to form a combined stream;

(B) partially condensing the combined stream and separating the partially condensed combined feed air stream to produce a first oxygen-enriched liquid and a first nitrogen-enriched vapor;

(C) separating the second portion of the higher pressure feed air stream to produce a second nitrogen-enriched vapor and a second oxygen-enriched liquid;

(D) passing the first nitrogen-enriched vapor together with the second nitrogen-enriched vapor to the non-adiabatic distillation device and partially condensing said vapor therein to produce condensate and nitrogen-rich vapor;

(E) passing the condensate combined with the second oxygen-enriched liquid to an upper section of the distillation column;

(F) condensing the nitrogen-rich vapor against column liquid to produce liquid nitrogen reflux and a combined vaporized stream;

(G) passing the combined vaporized stream and the liquid nitrogen reflux to an upper section of the distillation column, producing lower purity oxygen by cryogenic rectification within the distillation column and recovering lower purity oxygen from the lower section of the distillation column.

A further aspect of the invention is:

A method for producing lower purity oxygen by cryogenic rectification of feed air employing a non-adiabatic distillation device within a distillation column, comprising:

(A) providing a lower pressure feed air stream and a higher pressure feed air stream having a first portion and a second portion, expanding the first portion of the higher pressure feed air stream and passing the expanded first portion into a distillation column;

(B) partially condensing the lower pressure feed air stream and separating the resulting partially condensed feed air stream to produce a first oxygen-enriched liquid and a first nitrogen-enriched vapor;

(C) separating the second portion of the higher pressure feed air stream to produce a second nitrogen-enriched vapor and a second oxygen-enriched liquid;

(D) passing the first nitrogen-enriched vapor together with the second nitrogen-enriched vapor to the non-adiabatic distillation device and partially condensing said vapor therein to produce condensate and nitrogen-rich vapor;

(E) passing the condensate combined with the second oxygen-enriched liquid to an upper section of the distillation column;

(F) condensing the nitrogen-rich vapor against column liquid to produce liquid nitrogen reflux and a combined vaporized stream;

(G) passing the combined vaporized stream and the liquid nitrogen reflux to an upper section of the distillation column, producing lower purity oxygen by cryogenic rectification within the distillation column and recovering lower purity oxygen from the lower section of the distillation column.

As used herein the term "non-adiabatic distillation device" means a device that combines the operations of continuous countercurrent liquid and vapor contact for mass transfer with heat exchange between the first fluids undergoing mass transfer with one or more other fluids wherein the other fluids do not exchange mass with the first fluids within the device.

As used herein the term "reflux condenser" means a non-adiabatic distillation device wherein a first vapor stream is at least partially condensed by heat exchange with one or more other fluids within the device. The resulting liquid stream flows under gravity countercurrent to the first vapor stream and exchanges mass with the first vapor stream, and neither the first vapor stream nor the resulting liquid stream exchange mass with the other fluids.

As used herein the term "feed air" means a mixture comprising primarily nitrogen and oxygen, such as ambient air.

As used herein, the terms "turboexpansion" and "turboexpander" mean respectively method and apparatus for the flow of high pressure gas through a turbine to reduce the pressure and the temperature of the gas.

As used herein, the term "column" means a distillation or fractionation column or zone, i.e., a contacting column or zone wherein liquid and vapor phases are countercurrently contacted to effect separation of a fluid mixture, as for example, by contacting or the vapor and liquid phases on a series of vertically spaced trays or plates mounted within the column and/or on packing elements which may be structured packing and/or random packing elements. For a further discussion of distillation columns see the Chemical Engineers' Handbook fifth edition, edited by R. J. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at temperatures at or below 150 degrees Kelvin (K).

As used herein, the term "indirect heat exchange" means the bringing of two fluids into heat exchange relation without any physical contact or intermixing of the fluids with each other.

BRIEF DESCRIPTION OF THE DRAWINGS

Other objects, features and advantages will occur to those skilled in the art from the following description of preferred embodiments and the accompanying drawings, in which.

Figure 1:
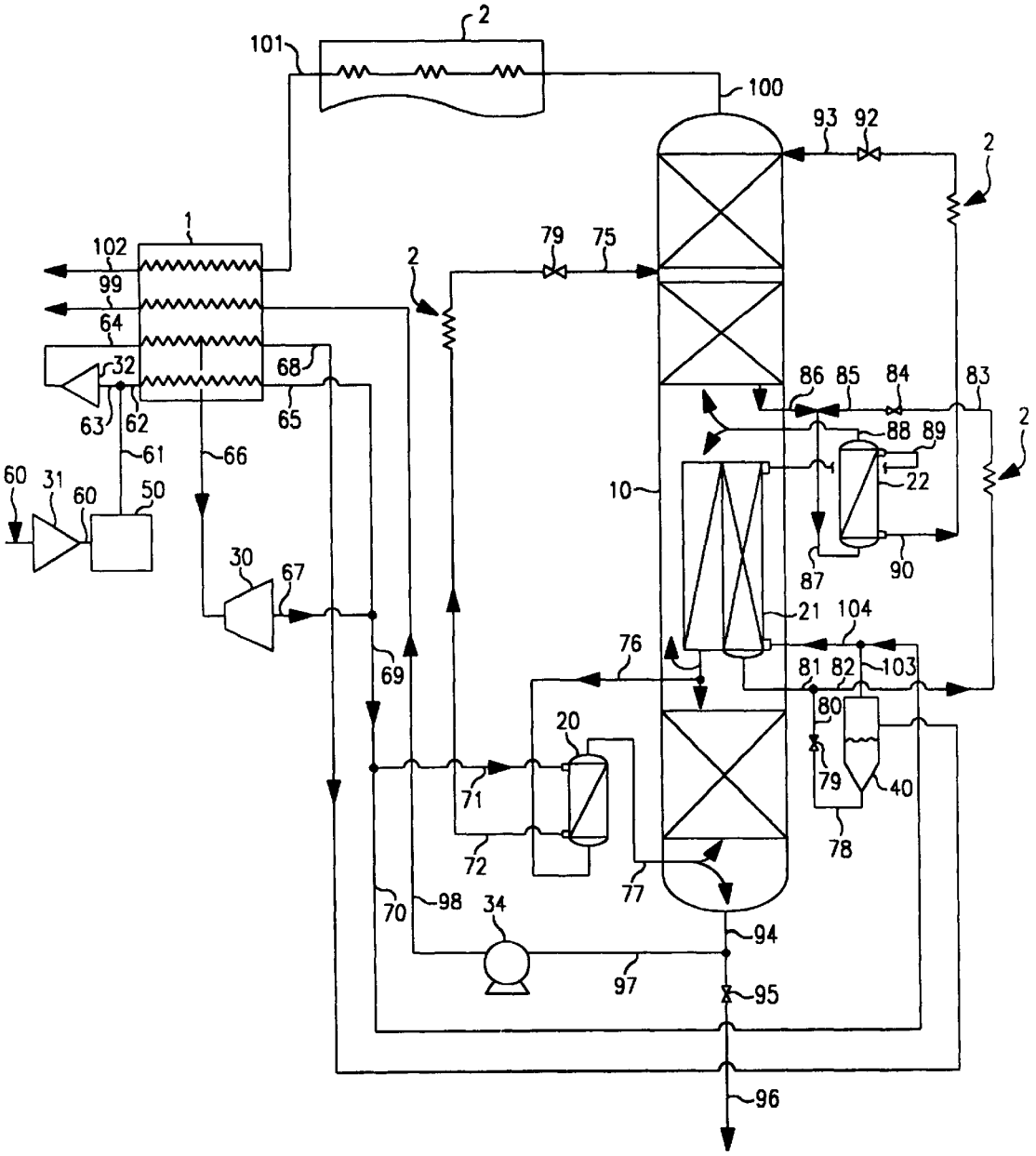
FIG. 1 is a schematic diagram of one preferred embodiment of the invention wherein a portion of a lower pressure feed air stream is directly provided to a non-adiabatic distillation device and a remaining portion of the lower pressure feed air stream is condensed against column liquid from the non-adiabatic distillation device, then provided to an upper section of the column, and a higher pressure feed air stream is provided to the non-adiabatic distillation device.

In the drawings the numerals are the same for the common elements and such common elements are not described in detail in subsequent embodiments.

DETAILED DESCRIPTION OF THE INVENTION

The main feature of this invention is the production of lower purity oxygen by the incorporation of a non-adiabatic distillation device into a distillation column which reduces the thermodynamic irreversibilities of the distillation while still maintaining simplicity of equipment. This improves the purity of the reflux used at the top of the column to a range of about 80% to about 99% nitrogen, which raises oxygen recoveries to attractive levels within the range of about 75% to about 98%.

This invention provides significant advantages. For example, the capital cost of such a system is low since a single distillation column may be employed. In addition, the energy consumption is also low because the non-adiabatic distillation device reduces the required pressure of the feed air to the system.

The non-adiabatic distillation device situated within a distillation column may actually be physically located inside or outside the distillation column. In either case, the non-adiabatic distillation device partially vaporizes liquid descending in the distillation column. When the non-adiabatic distillation device is located outside of the column, descending liquid can be collected and passed to the distillation device and the resulting two phase stream can be returned to the column.

Generally, lower purity oxygen has an oxygen concentration of less than 99 mole percent. Oxygen of about 50 to about 98 mole percent purity can be efficiently produced in the practice of this invention by embedding a non-adiabatic distillation device into a single column. This device preferably takes the form of a reflux condenser located in the mid-section of a single distillation column. Preferably, the location of the device is between the bottom reboiler and the point where oxygen-enriched liquid or liquid air is introduced to the column.

Referring now to FIG. 1, feed air 60 is compressed in compressor 31 and delivered to prepurifier 50 where the feed air is cleaned of moisture, carbon dioxide and hydrocarbons in the fashion well known to the industry. A portion of the purified feed air in piping 61 is split off in piping 63 as suction for booster compressor 32. This boosted feed air is then delivered to primary heat exchanger 1 by way of piping 64. The boosted feed air is then cooled to the midpoint of primary heat exchanger 1 where a portion may be removed in piping 66 as turboexpander 30 feed. The remaining portion of the boosted feed air continues on in primary heat exchanger 1 to near its cold end where it is condensed against product oxygen which has been pumped to approximately the desired delivery pressure by pump 34 and delivered to primary heat exchanger 1 via piping 98. The condensed boosted air stream is passed via piping 68 from the cold end of the heat exchanger to separator 40 where its pressure is reduced causing the formation of nitrogen-enriched vapor stream 103 and liquid stream 78.

The remaining purified feed air stream 62 is cooled in primary heat exchanger 1 and leaves the cold end in piping 65. The turbine 30 exhaust 67 may be combined with stream 65 to form combined stream 69. A fraction of this combined stream is then passed by piping 71 to reboiler 20 where it is condensed against partially vaporizing column liquid coming by way of piping 76 from reflux condenser 21. The resulting partially vaporized column liquid 77 is admitted to the bottom of distillation column 10 as bottoms product and reboil for distillation column 10. The condensed feed air passes out of reboiler 20 in stream 72, is subcooled by passage through heat exchanger 2 by indirect heat exchange with nitrogen stream 100, and then passed through valve 79 and, as stream 75 into an upper section of column 10. The remainder of the combined stream 69 continues in piping 70 to join with vapor stream 103 leaving separator 40 and together form feed stream 104 to the reflux condenser 21.

Nitrogen-enriched vapor is progressively condensed over the height of the reflux condenser thus producing a higher purity nitrogen-enriched vapor at the top and an oxygen-rich liquid at the bottom. The vapor issuing from the top of reflux condenser 21 is then passed through piping 89 to be condensed in heat exchanger 22 and may then be transferred to nitrogen superheater 2 by piping 90. Throttling by valve 92 and passage through piping 93 delivers the liquid nitrogen as reflux to the top of distillation column 10. Oxygen-rich bottoms liquid of reflux condenser 21 is withdrawn by piping 81 and combined with liquid 78 from separator 40 via valve 79 and piping 80. The combined streams 82 may then be transferred through another section of nitrogen superheater 2, and is then transferred by piping 83, valve 84 and piping 85, together with column liquid 86, as stream 87 to the bottom of heat exchanger 22 where it is partially vaporized before being returned to column 10 as stream 88. Vapor rises into the next column section above and liquid is distributed to the top of reflux condenser 21. Liquid is evaporated progressively in reflux condenser 21 and vapor flows downward in the same direction as the liquid. Vapor issuing from the bottom of reflux condenser 21 then rises to join vapor from heat exchanger 22 to form additional reboil for column 10 above reflux condenser 21. A portion of the liquid effluent from the bottom of the reflux condenser 21 is withdrawn from column 10 by way of piping 76 to reboiler 20 where it is partially vaporized to serve as reboil for column 10 and joins the bottoms product oxygen from the bottom section of column 10. Liquid lower purity oxygen product may be withdrawn through piping 94, valve 95, and product piping 96. If a portion of oxygen product is desired in the gaseous form, such portion is removed in piping 97, pumped to delivery pressure in pump 34, transferred via piping 98 to primary heat exchanger 1 where it is vaporized and warmed to ambient temperature for delivery in piping 99. Nitrogen from the top of column 10 may be piped to nitrogen superheater 2 by way of piping 100. The nitrogen is then passed to the cold end of primary heat exchanger 1 in stream 101 where it is warmed to ambient temperature and removed from the system in stream 102. By using this cycle oxygen purities up to 98 mole percent can be produced at oxygen recoveries above 90 percent. Economically attractive power requirements are likewise obtained. Those skilled in the art will recognize that in the drawings, for the sake of simplification, heat exchanger 2 is illustrated in broken fashion. In actual practice the flows labeled as passing through heat exchanger 2 would be in proximate countercurrent flow in indirect heat exchange relation.

Figure 2:
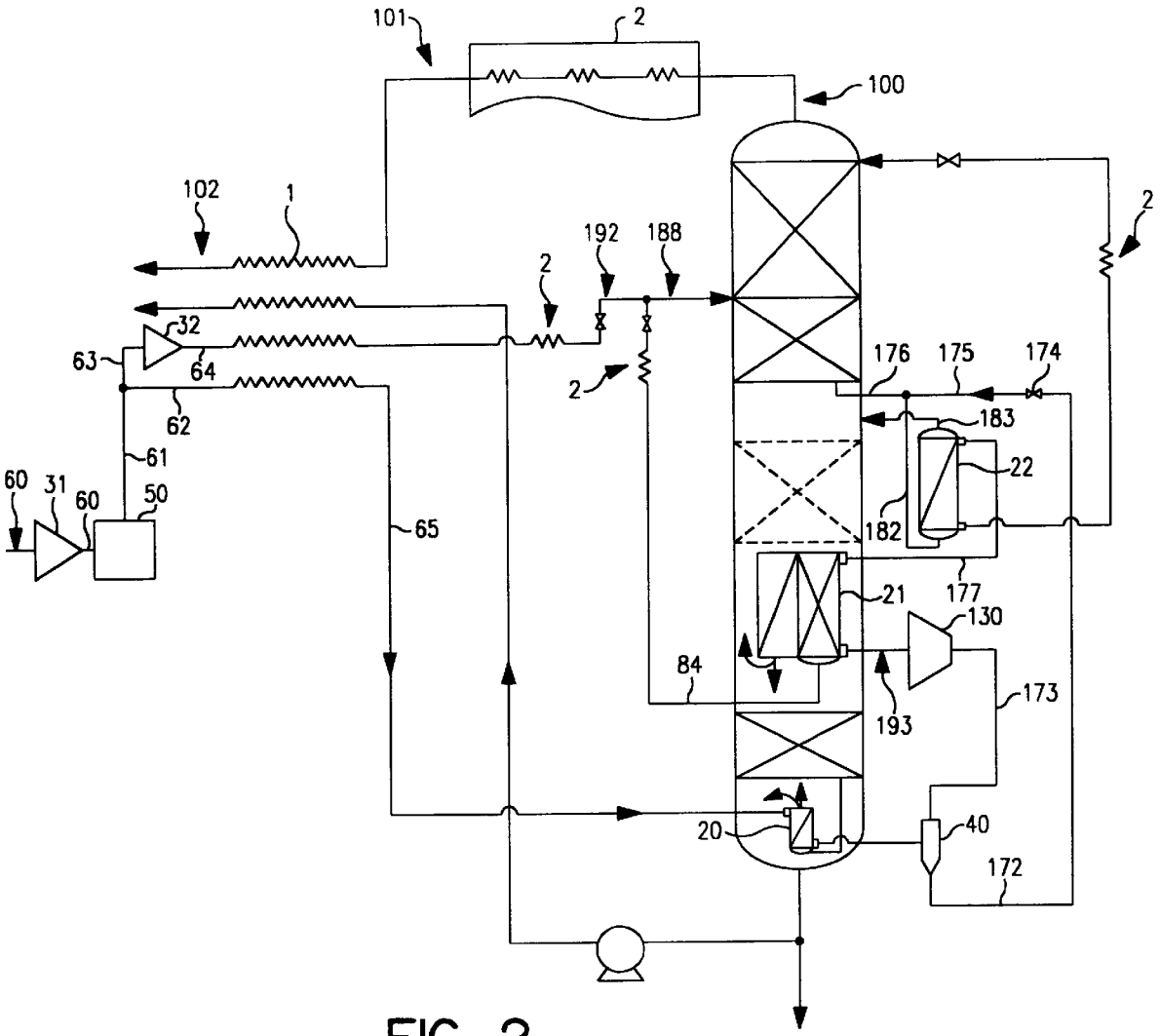
FIG. 2 is a schematic diagram of another preferred embodiment of the invention wherein a high pressure feed air stream is liquefied and provided to an upper section of a distillation column and a lower pressure feed air stream is condensed, expanded and provided to a non-adiabatic distillation device.

In FIG. 2, the entire high pressure feed air stream 64 is cooled and condensed in heat exchanger 1 and supplied via piping 192 directly to an upper section of the distillation column. Feed air stream 62 is cooled in heat exchanger 1, and supplied via stream 65 to reboiler 20. Reflux condenser 21 operates as a down-flow cocurrent evaporator on the boiling side. All of the liquid descending within column 10 enters the evaporating side of reflux condenser 21 where it is partially vaporized with a two phase stream emerging at the bottom. On the condensing side of reflux condenser 21 nitrogen-rich vapor obtained by partial condensation of feed air 65 in reboiler 20, separation in separator 40, and expansion in turboexpander 130, is transferred to reflux condenser 21 by piping 193 where it is partially condensed with the resulting condensate accumulating at the bottom of reflux condenser 21. This condensate is transferred by piping 184, subcooled in nitrogen superheater 2, combined with high pressure air 192 and provided to an upper section of the column as stream 188. The nitrogen-rich vapor not condensed in reflux condenser 21 is piped by piping 177 to intermediate reboiler 22 where it is totally condensed and transferred to the top of column 10 as reflux. Refrigeration for condensing stream 177 is supplied by partially vaporizing column liquid supplied through piping 176 and condensate from separator 40 by way of piping 172, valve 174 and piping 175 which joins piping 176 from column 11 in piping 182. The vapor returns to column 10 by piping 183. Oxygen recovery is increased to 97 percent by this arrangement.

Figure 3:
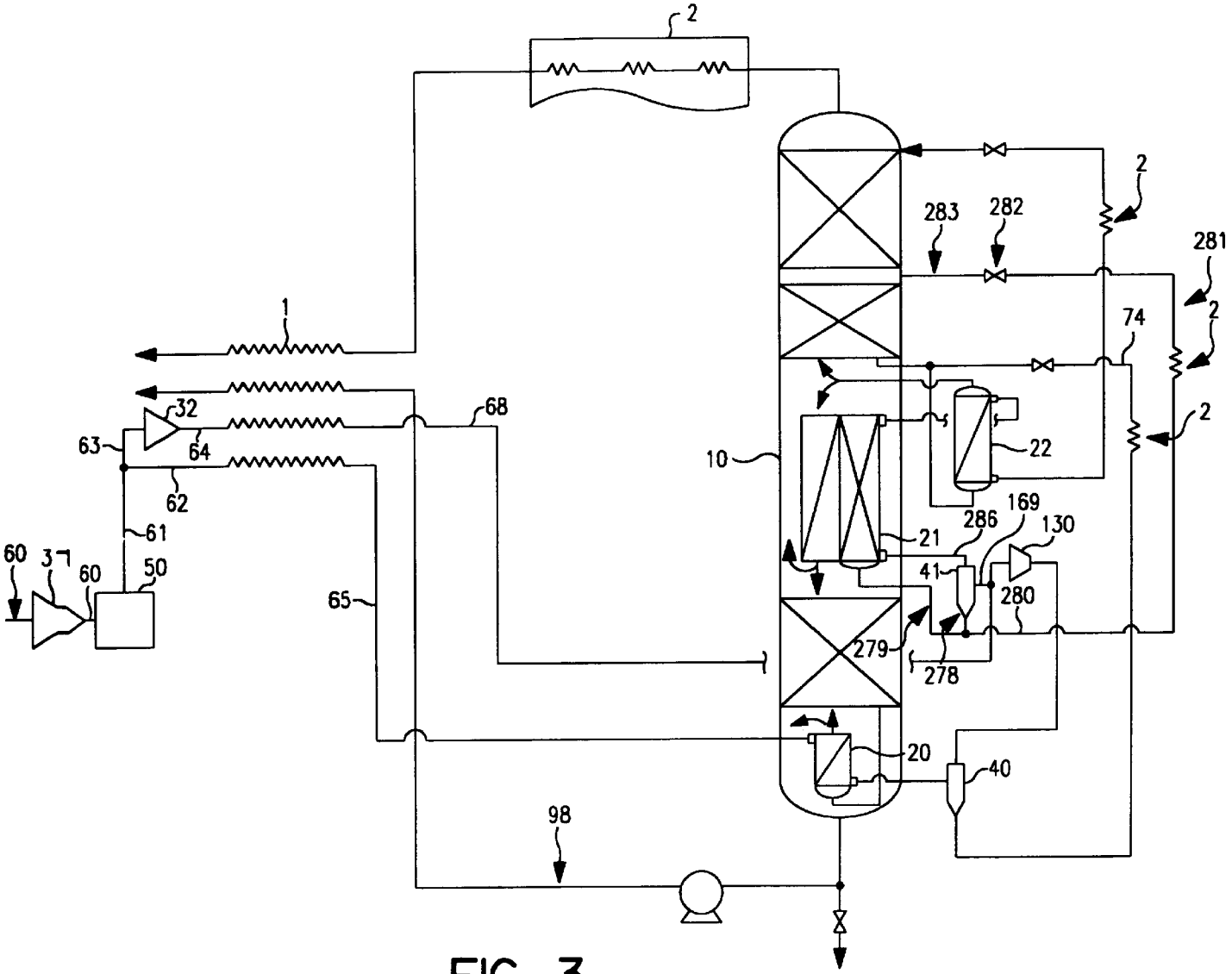
FIG. 3 is a schematic diagram of another preferred embodiment of the invention wherein a higher pressure feed air stream is liquefied and mixed with liquid from the non-adiabatic distillation device and a lower pressure feed air stream is condensed, expanded and provided to the non-adiabatic distillation device.

FIG. 3 shows another embodiment of the invention, a single column of a low purity oxygen process in which a reflux condenser within the column is used to generate a relatively pure reflux for the top of the column. As in FIG. 2, lower pressure feed air 62 is cooled and provided to reboiler 20 where it is condensed then separated in separator 40. Turbine 130 is fed with vapor from separator 40 by piping 173. After expansion therein, turbine 130 exhaust is combined with high pressure air from cold end piping 68 having been partially condensed in primary heat exchanger 1 against vaporizing product oxygen 98. The combined streams enter separator 41 by piping 169. The nitrogen-rich vapor from separator 41 is admitted to the condensing side of reflux condenser 21 by piping 286. This vapor is partially condensed within reflux condenser 21 with the resulting liquid accumulating at the bottom of reflux condenser 21. The liquid leaving the bottom of reflux condenser 21 in piping 279 is combined with the second oxygen-rich liquid in piping 278 from separator 41 and transferred by piping 280 to nitrogen superheater 2. Piping 281 conducts the superheated liquid to valve 282 where it is throttled into column 10 by piping 283. Liquid from separator 40 via piping 272, 274, valve 275, and piping 276 is combined with column 10 liquid by way of piping 277 in piping 287. This combined liquid is partially vaporized in intermediate heat exchanger 22. The combined partially vaporized stream 288 is returned to column 10. The liquid contained in this stream 288 passes through the boiling side of reflux condenser 21 where it is partially vaporized. With the embodiment of FIG. 3, oxygen recovery is about 97 percent. Sufficient refrigeration is available from this process to produce a small amount of liquid product as backup for the air separation plant.

The arrangements shown in FIGS. 2 and 3 produce sufficient refrigeration to sustain an air separation plant and export a small amount of liquid as long as the oxygen purity is above 85 percent. In a number of applications, such as reheating in the steel industry, an oxygen purity of less than 85 may be desired. As oxygen purity is reduced below 85 percent the head pressure of the processes shown in FIGS. 2 and 3 falls below 40 psia causing the pressure ratio across the turbine to drop to an insignificant value.

Figure 4:
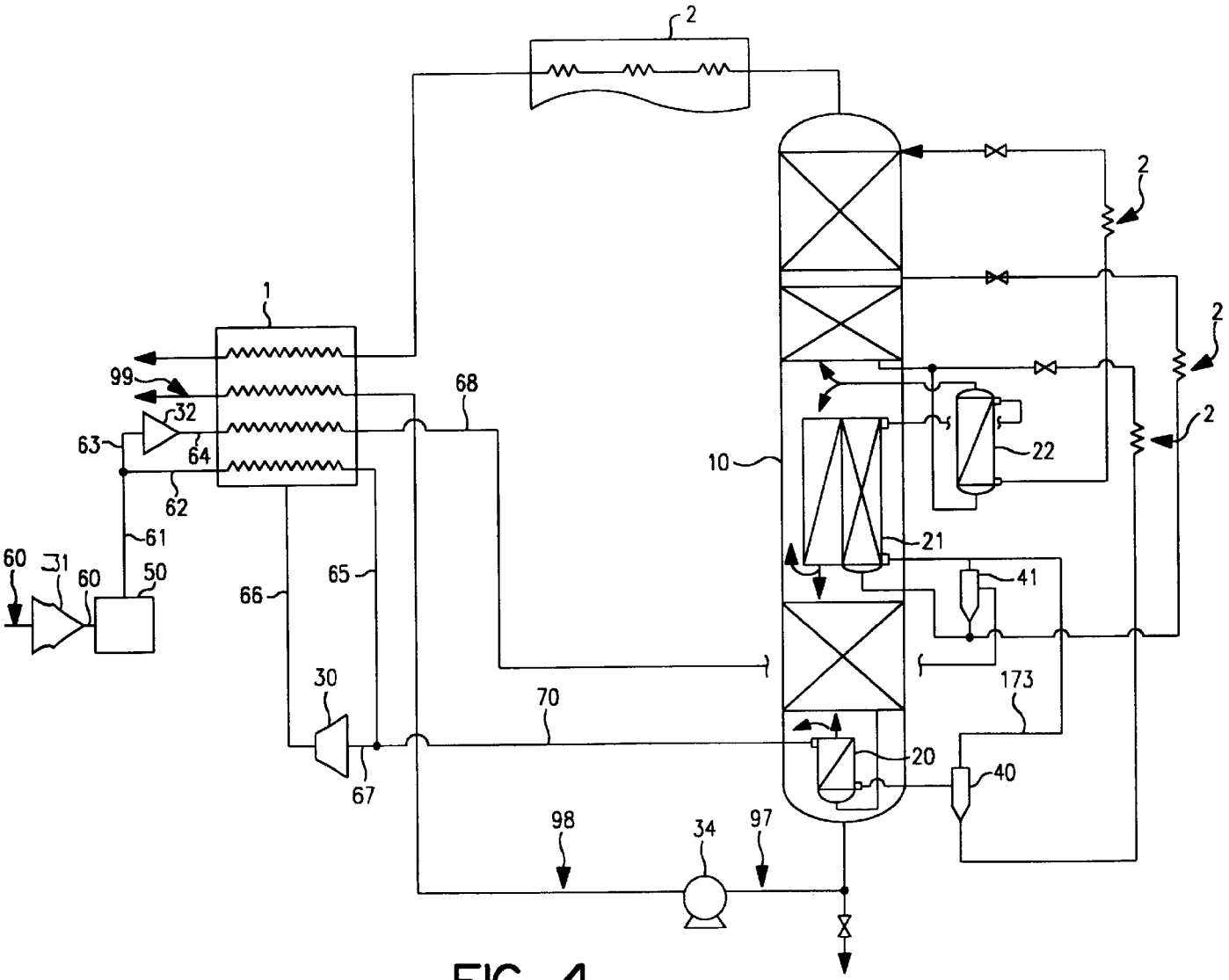
FIG. 4 is a schematic diagram of a preferred embodiment of the invention wherein, a portion of a higher pressure feed air stream is liquefied and mixed with liquid from the non-adiabatic distillation device, and the remaining portion of higher pressure feed air is expanded and combined with a lower pressure feed air stream, and the combined stream is condensed and provided to the non-adiabatic distillation device.

FIG. 4 shows an arrangement whereby the head pressure of the process may be reduced, therefore reducing the unit power for oxygen produced, for an oxygen purity of 85 mole percent or lower, typically between 50 to 85 mole percent, by the use of the embedded reflux condenser process of this invention. Additional air may be boosted by the compressor stage used to provide the high pressure air necessary to boil the liquid oxygen in the primary heat exchanger. The primary change is the relocation of the turbine.

A portion of the boosted air from compressor 32 is delivered to primary heat exchanger 1 where it is cooled to an intermediate temperature and withdrawn in piping 66 as feed to turbine 30. The exhaust from turbine 30 in piping 67 is combined with low pressure cold end air in piping 65 and joined in piping 70 to be delivered to reboiler 20. The remainder of the high pressure air continues on through primary heat exchanger 1 where it provides the heat to convert the liquid oxygen product delivered to primary heat exchanger 1 in piping 98 to a vapor 99. Stream 173, vapor from separator 40 is combined with the nitrogen-rich vapor from the top of separator 41 and provided to the non-adiabatic distillation device. The remainder of the process is the same as in FIG. 3.

Figure 5:
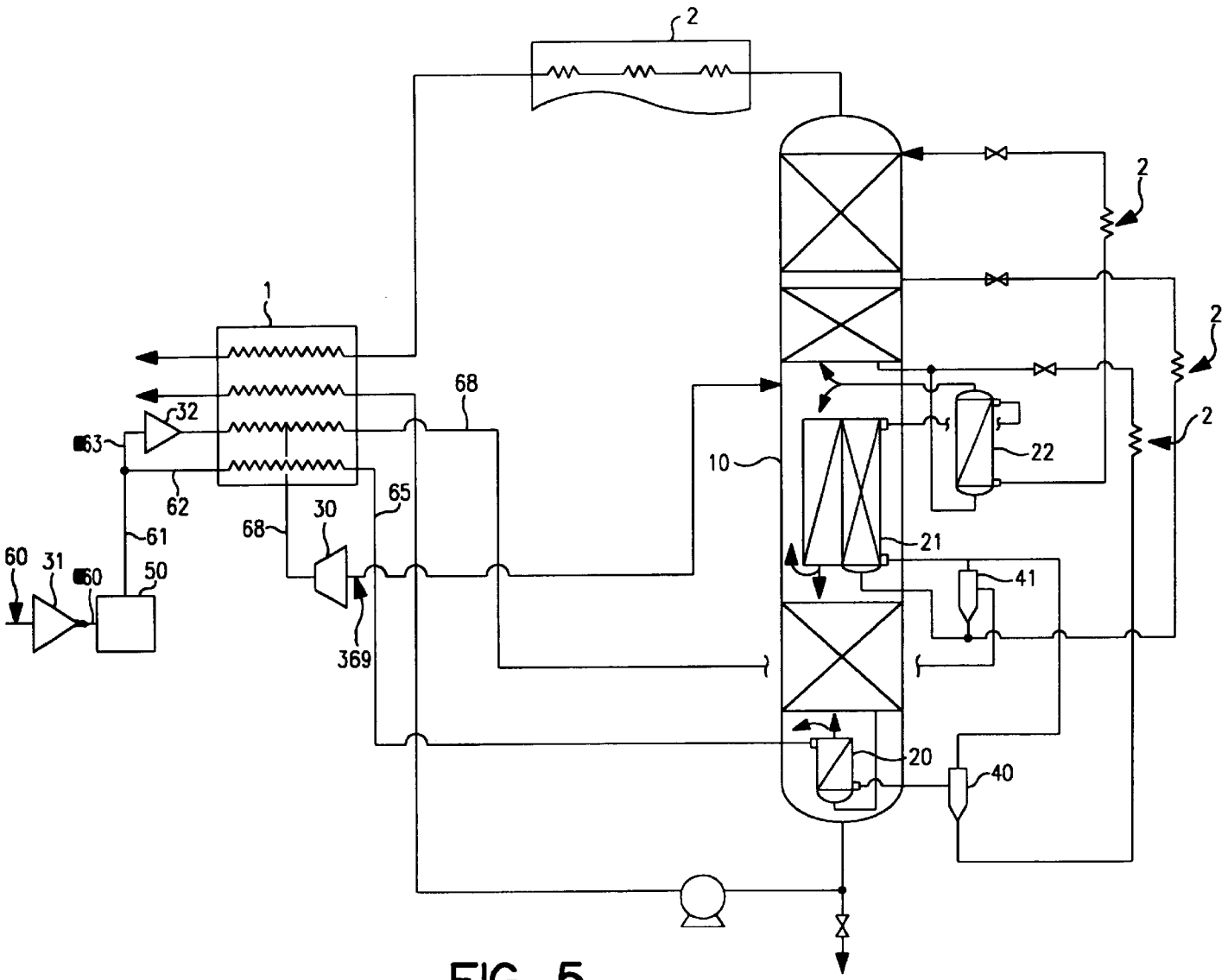
FIG. 5 is a schematic diagram of another preferred embodiment of the invention wherein a lower pressure feed air stream is partially condensed against column bottom liquid, and the vapor portion provided to a non-adiabatic distillation device while a portion of a higher pressure feed air stream is expanded and directly provided to the column.

An alternate to FIG. 4 is shown in FIG. 5. The primary change for this alternative is that the turbine exhaust is directed to the column rather than the reboiler. As shown in FIG. 5 turbine 30 takes its feed from an intermediate point in primary heat exchanger 1 from piping 66. Turbine exhaust is directed to column 10 through piping 369. The location of the entry of turbine exhaust to column 10 is immediately above reflux condenser 21. Unit power will be slightly lower in this case.

The invention described will have widespread application. Many industries have the potential to use oxygen at purities below that of high purity. The key is to produce the oxygen at a sufficiently low cost to make it economically attractive to use. Combustion processes in the metallurgical, chemical, petrochemical, and coal gasification industries would be logical consumers of low cost, lower purity oxygen. Although the invention has been described in detail with reference to certain preferred embodiments, those skilled in the art will recognize that there are other embodiments of the invention within the spirit and the scope of the claims.

What is claimed is:

1. A method for producing lower purity oxygen by cryogenic rectification of feed air employing a non-adiabatic distillation device within a distillation column, comprising the steps of:

(A) condensing at least a portion of feed air to produce nitrogen-enriched vapor;

(B) passing the nitrogen-enriched vapor to a non-adiabatic distillation device situated within a distillation column, said distillation column having at least one upper section and at least one lower section with the non-adiabatic distillation device located therebetween, and partially condensing the nitrogen-enriched vapor therein to produce a higher purity nitrogen-enriched vapor;

(C) condensing the higher purity nitrogen-enriched vapor to produce a higher purity nitrogen-enriched liquid and passing the higher purity nitrogen-enriched liquid into an upper section of the distillation column; and (D) producing lower purity oxygen by cryogenic rectification within the distillation column and recovering lower purity oxygen from a lower section of the column.

2. The method of claim 1, wherein the non-adiabatic distillation device is a reflux condenser.

3. The method of claim 1, wherein the feed air comprises a condensed higher pressure stream and a lower pressure stream, and wherein, a) a first portion of the lower pressure stream is passed to the non-adiabatic distillation device, b) a second portion of the lower pressure stream is fully condensed against column liquid from the non-adiabatic distillation device to produce (i) liquid feed air and (ii) partially vaporized column liquid, and the partially vaporized column liquid is passed to a lower section of the distillation column and the liquid feed air to an upper section of the distillation column, and (c) the higher pressure stream is separated into (iii) a liquid stream and (iv) nitrogen-enriched vapor which is passed to the non-adiabatic distillation device within the column.

4. The method of claim 1, wherein the feed air comprises a partially condensed higher pressure stream and a lower pressure stream, and wherein, (a) the partially condensed higher pressure stream is provided to the distillation column and (b) the lower pressure stream is condensed by indirect heat exchange with column bottom liquid, and separated to produce (i) oxygen-enriched liquid and (ii) nitrogen-enriched vapor which is expanded and passed to the non-adiabatic distillation device.

5. The method of claim 4, further comprising:

combining condensate from the non-adiabatic distillation device with the higher pressure stream and passing the combined stream to the distillation column.

6. The method of claim 1, wherein the feed air comprises (a) a partially condensed higher pressure stream and (b) a lower pressure stream, and wherein, the lower pressure stream is condensed by indirect heat exchange with column bottom liquid and separated to produce (i) a first oxygen-rich liquid and (ii) a first nitrogen-enriched vapor, and wherein the first nitrogen-enriched vapor is expanded and combined with the partially condensed higher pressure stream, and the combined stream is separated to produce (iii) a second oxygen-enriched liquid and (iv) a second nitrogen-enriched vapor which is passed to the non-adiabatic distillation device.

7. A method for producing lower purity oxygen by cryogenic rectification of feed air employing a non-adiabatic distillation device within a distillation column, comprising:

(A) providing a lower pressure feed air stream and a higher pressure feed air stream having a first portion and a second portion, expanding the first portion of the higher pressure feed air stream and combining the expanded first portion of the higher pressure feed air stream with the lower pressure feed air stream to form a combined stream;

(B) partially condensing the combined stream and separating the partially condensed combined feed air stream to produce a first oxygen-enriched liquid and a first nitrogen-enriched vapor;

(C) separating the second portion of the higher pressure feed air stream to produce a second nitrogen-enriched vapor and a second oxygen-enriched liquid;

(D) passing the first nitrogen-enriched vapor together with the second nitrogen-enriched vapor to the non-adiabatic distillation device and partially condensing said vapor therein to produce condensate and nitrogen-rich vapor;

(E) passing the condensate combined with the second oxygen-enriched liquid to an upper section of the distillation column;

(F) condensing the nitrogen-rich vapor against column liquid to produce liquid nitrogen reflux and a combined vaporized stream;

(G) passing the combined vaporized stream and the liquid nitrogen reflux to an upper section of the distillation column, producing lower purity oxygen by cryogenic rectification within the distillation column and recovering lower purity oxygen from the lower section of the distillation column.

8. A method for producing lower purity oxygen by cryogenic rectification of feed air employing a non-adiabatic distillation device within a distillation column, comprising:

(A) providing a lower pressure feed air stream and a higher pressure feed air stream having a first portion and a second portion, expanding the first portion of the higher pressure feed air stream and passing the expanded first portion into a distillation column;

(B) partially condensing the lower pressure feed air stream and separating the resulting partially condensed feed air stream to produce a first oxygen-enriched liquid and a first nitrogen-enriched vapor;

(C) separating the second portion of the higher pressure feed air stream to produce a second nitrogen-enriched vapor and a second oxygen-enriched liquid;

(D) passing the first nitrogen-enriched vapor together with the second nitrogen-enriched vapor to the non-adiabatic distillation device and partially condensing said vapor therein to produce condensate and nitrogen-rich vapor;

(E) passing the condensate combined with the second oxygen-enriched liquid to an upper section of the distillation column;

(F) condensing the nitrogen-rich vapor against column liquid to produce liquid nitrogen reflux and a combined vaporized stream;

(G) passing the combined vaporized stream and the liquid nitrogen reflux to an upper section of the distillation column, producing lower purity oxygen by cryogenic rectification within the distillation column and recovering lower purity oxygen from the lower section of the distillation column.

* * * * *